US009677310B1

(12) United States Patent
Russo et al.

(10) Patent No.: US 9,677,310 B1
(45) Date of Patent: Jun. 13, 2017

(54) CAM HINGE WITH TENSION CONTROL SYSTEM

(71) Applicant: Barrette Outdoor Living, Inc., Middleburg Heights, OH (US)

(72) Inventors: Daniel Russo, Brecksville, OH (US); Antonello Nizzia, Turin (IT)

(73) Assignee: BARRETTE OUTDOOR LIVING, INC., Middleburg Heights, OH (US)

( * ) Notice: Subject to any disclaimer, the term of this patent is extended or adjusted under 35 U.S.C. 154(b) by 242 days.

(21) Appl. No.: 14/595,534

(22) Filed: Jan. 13, 2015

(51) Int. Cl.
*E05F 1/02* (2006.01)
*E05D 7/00* (2006.01)

(52) U.S. Cl.
CPC ..... *E05D 7/0027* (2013.01)

(58) Field of Classification Search
CPC ..... E05D 7/0027; E05F 1/063; Y10T 16/539; Y10T 16/5398; Y10T 16/53984; Y10T 16/53985; Y10T 16/53988
See application file for complete search history.

(56) References Cited

U.S. PATENT DOCUMENTS 583,536 A 6/1897 Masters
3,098,258 A * 7/1963 Ruiz ..... E05F 1/1223 16/312
3,401,422 A * 9/1968 Ventura ..... E05F 1/061 16/317
3,748,688 A * 7/1973 Berkowitz ..... E05F 1/063 16/247
3,975,794 A * 8/1976 Kaiser ..... E05F 1/063 16/303
4,030,161 A * 6/1977 Loikitz ..... E05F 1/063 16/284
4,951,351 A * 8/1990 Eckel ..... E05F 1/1223 16/284
4,991,259 A * 2/1991 Finkelstein ..... E05F 1/063 16/312
5,133,152 A * 7/1992 Grancagnolo ..... E05D 11/04 16/312
5,138,743 A * 8/1992 Hoffman ..... E05F 1/1223 16/303
5,600,868 A * 2/1997 Tourville ..... E05F 1/1223 16/277

(Continued)

*Primary Examiner* — Victor Batson
*Assistant Examiner* — Matthew Sullivan
(74) *Attorney, Agent, or Firm* — Maldjian Law Group LLC

(57) ABSTRACT

A self closing and adjustable closing force cam hinge includes a compression spring located on the hinge so that a hinge pin passes through the compression spring and the head of the hinge pin is retracted in a direction away from the compression spring to compress the compression spring. Compression of the spring applies a closing force to the hinge when the hinge is in the open position. The hinge also includes a spring adjuster having an adjustably positionable body that is adjustably positionable relative to the head of the hinge pin. Adjustment of the position of the adjustably positionable body raises or lowers the head of the hinge pin such that raising of the hinge pin increases compression of the compression spring to increase the closing force applied by the compression spring and lowering of the hinge decreases compression of the compression spring to decrease the closing force applied by the compression spring.

6 Claims, 6 Drawing Sheets

(56) References Cited

U.S. PATENT DOCUMENTS

| | | | | |
|---|---|---|---|---|
| 6,715,182 | B2 * | 4/2004 | Cheng | E05F 1/063 16/280 |
| 7,000,289 | B2 * | 2/2006 | Cedrone | E05F 1/063 16/273 |
| 7,013,531 | B2 * | 3/2006 | Jackson | E05F 1/063 16/309 |
| 7,328,483 | B2 * | 2/2008 | Chen | H04M 1/0216 16/303 |
| 7,945,996 | B2 * | 5/2011 | Gunderson | E05F 1/061 16/303 |
| 8,245,353 | B2 | 8/2012 | Homner et al. | |
| 8,621,715 | B2 * | 1/2014 | Mitchell | E05D 5/04 16/303 |
| 8,689,403 | B2 * | 4/2014 | Lowen | E05D 11/1071 16/309 |
| 8,701,248 | B2 * | 4/2014 | Dries | E05D 5/10 16/280 |
| 8,800,109 | B1 * | 8/2014 | Mitchell | E05D 11/0054 16/238 |
| 9,140,045 | B1 * | 9/2015 | Finkelstein | E05D 7/04 |
| 9,416,574 | B2 * | 8/2016 | Mitchell | E05D 7/0423 |
| 2006/0090297 | A1 * | 5/2006 | Chue | E05D 5/04 16/312 |

* cited by examiner

CAM HINGE WITH TENSION CONTROL SYSTEM

FIELD

This disclosure relates to the field of hinges. More particularly, this disclosure relates to a cam hinge having a spring with adjustable tension to provide an adjustable closing force.

BACKGROUND

Cam hinges or lift hinges are commonly used in indoor applications where there is a need to lift the door to overcome thresholds or the like obstacles at floor level, or when the floor below the door is inclined or sloped. Conventional cam springs desire improvement in many regards.

What is desired is a cam hinge that is configured to have spring-assisted closing as a feature. Also desired is a cam hinge with spring assisted closing, with adjustability of the spring tension so as to permit adjustment of the closure speed.

The present disclosure advantageously provides a cam hinge having spring assisted closing, with adjustability of the spring tension to provide adjustable closing speed.

SUMMARY

The above and other needs are met by a self-closing and adjustable closing force cam hinge.

In one aspect, the hinge includes a stationary hinge portion having a hinge body; a pivoting hinge portion having a hinge body; and a hinge pin having a head and passing through the hinge body of the stationary hinge portion and the hinge body of the pivoting hinge portion. The pivoting hinge portion pivots about the hinge pin relative to the stationary hinge portion and cooperates with the stationary hinge portion to enable the pivoting hinge portion to lift as the pivoting hinge portion is rotated from a closed position to an open position and to lower as the pivoting hinge portion is rotated from the open position to the closed position.

A compression spring is located on the hinge so that the hinge pin passes through the compression spring and the head of the hinge pin is retracted from the compression spring to compress the compression spring so that the compression spring applies a closing force to the hinge when the hinge is in the open position. A spring adjuster includes an adjustably positionable body that is adjustably positionable relative to the head of the hinge pin.

Adjustment of the position of the adjustably positionable body raises or lowers the head of the hinge pin such that raising of the hinge pin increases compression of the compression spring to increase the closing force applied by the compression spring and lowering of the hinge decreases compression of the compression spring to decrease the closing force applied by the compression spring.

In another aspect, a self closing and adjustable closing force hinge includes a hinge openable and closeable between an open position and a closed position. The hinge has a compression spring located on the hinge so that a hinge pin passes through the compression spring and a head of the hinge pin is retracted in a direction away from the compression spring to compress the compression spring. The compression spring applies a closing force to the hinge when the hinge is in an open position.

A spring adjuster is located on the hinge and includes an adjustably positionable body that is adjustably positionable relative to the head of the hinge pin. Adjustment of the position of the adjustably positionable body raises or lowers the head of the hinge pin. Raising of the hinge pin increases compression of the compression spring to increase the closing force applied by the compression spring and lowering of the hinge decreases compression of the compression spring to decrease the closing force applied by the compression spring.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
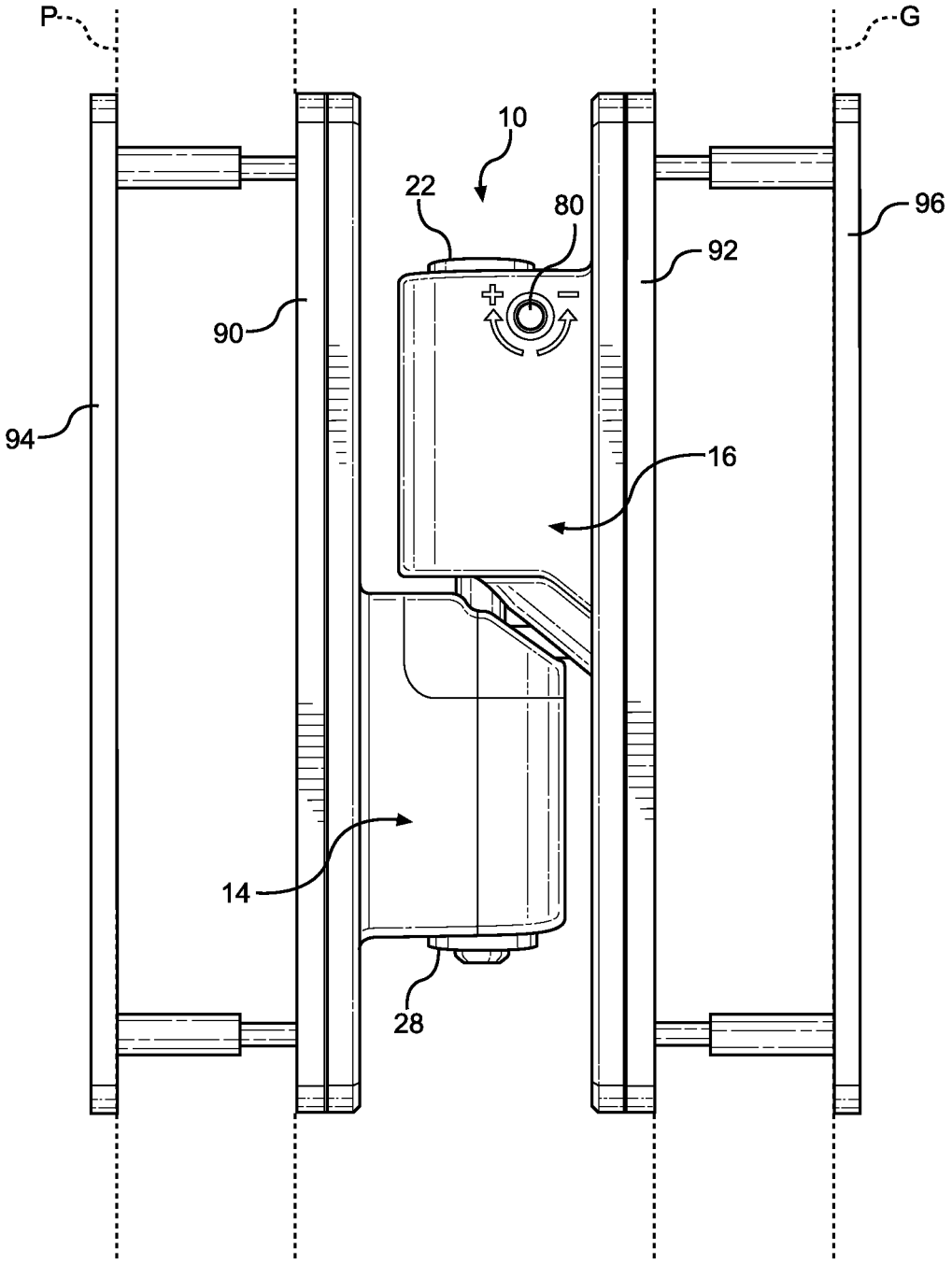
FIG. 1 is a side view of a cam hinge according to the disclosure with the hinge in a position corresponding to a gate supported by the hinge being in a fully closed position.
Figure 2:
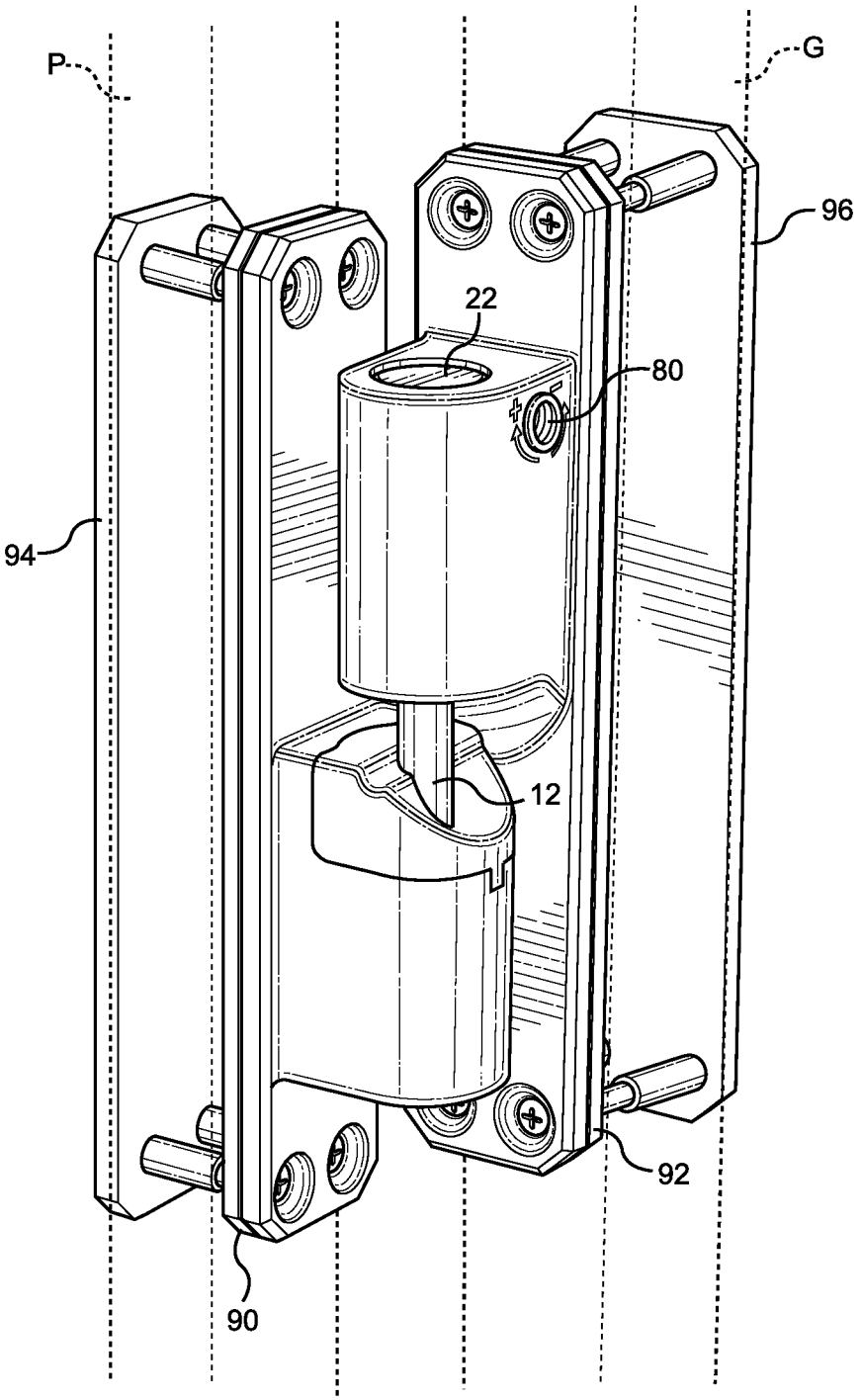
FIG. 2 is a perspective view of a cam hinge according to the disclosure with the hinge in a position corresponding to a gate supported by the hinge being in a fully open position.

With reference to the drawings, the disclosure relates to a bi-directional cam hinge 10 configured to have spring assisted closing, with adjustability of the spring tension to provide adjustable closing speed. The hinge 10 is particularly suitable for use as a hinge for attaching a fence gate to a fence post, and particularly for a vinyl fence and gate. The hinge 10 is configured to function in either direction so that a gate can be opened either with clockwise or counterclockwise rotation of the hinge 10. However, but it will be understood that it could be configured to function for only one direction of rotation.

The hinge 10 includes a hinge pin 12, a lower stationary hinge portion 14, and an upper pivoting hinge portion 16.

The hinge 10 includes a compression spring 18 for spring assisted closing of the hinge 10.

The hinge pin 12 is an elongate, preferably metal, pin having a shaft 20 with an enlarged head 22 at one end and a distal end 24 at the opposite end. The compression spring 18 is installed on the pin 12 adjacent the distal end 24 of the pin 12. The distal end 24 may be tapered and includes a circumferential groove 26 for interfacing with a fastener, such as a retaining ring 28, for retaining the compression spring 18. As shown, a washer may be located between the end of the spring 18 and the retaining ring 28.

The lower stationary hinge portion 14 includes an elongate generally planar base 30 for mounting the lower stationary hinge portion 14 adjacent to a fence post P or the like as by use of screws passed through apertures 32. A hinge body 34 extends outwardly from the base 30, and includes a central vertical bore 36 that extends through the hinge body 34 and is open at each end. A lower end 36*a* of the bore 36 has an enlarged diameter for receiving the compression spring 18. An upper end 38 of the hinge body 34 is configured to receive a cam insert 40.

The cam insert 40 is configured to sit on and nest with the upper end 38 of the hinge body and provide an exterior cam surface 42 with a through bore 44 aligned with the bore 36. The cam insert 40 may include a key or projection 46 received by a corresponding lock or notch 48 on the hinge body 34 to secure the cam insert 40 to the hinge body 34 and inhibit relative movement thereof. In this regard, the cam insert 40 is configured as a separate piece to simplify manufacturing and reduce manufacturing costs. However, it will be understood that the hinge body 34 may be formed of one piece construction to include the cam surface 42.

The upper pivoting hinge portion 16 includes an elongate generally planar base 60 for mounting the upper pivoting hinge portion 16 adjacent to a fence gate G or the like as by use of screws passed through apertures 62. A hinge body 64 extends outwardly from the base 60, and includes a central vertical bore 66 that extends through the hinge body 64 and is open at each end. An upper end 66*a* of the bore 66 has an enlarged diameter for receiving the head 22 of the hinge pin 12. A lower end 68 of the hinge body 64 is rounded and otherwise configured to include a cam surface configured to cooperate with the cam surface 42 of the hinge body 34 to enable cam or lift hinge operation of the hinge 10.

A guide 70 is located on the lower end 68 of the hinge body 64. The guide 70 may be provided, for example, as by a pin or the like extending through an aperture 72 located adjacent the lower end 68 of the hinge body 64. The guide 70 directly contacts the cam surface 42 to follow the contour thereof. For example, the cam surface 42 is a generally rounded and rising sloped surface, and the lower end 68 of the hinge body 64 is generally rounded and oppositely sloped so as to provide clearance as the hinge rotates as guided by the guide 70 traveling along the cam surface.

When the gate G is closed, the lower end 68 is at its lowest position. As the gate G is opened, either clockwise or counter clockwise, the guide 72, and hence the lower end 68, follows the contour of the cam surface 42 and the hinge body 64 rotates and rises relative to the hinge body 34. As the gate is closed, this is reversed. The compression spring 18 provides a downward pull on the hinge body 64 via the head 22 of the hinge pin 12 bearing on the hinge body 64 to provide a closing force.

The guide 70 also functions to enable the gate G to resist the force of the compression spring 18 and remain in a fully open position, the hinge body 64. The guide 70 cooperates with a notch 74 defined across an upper portion of the cam surface 42 so as to reside in the notch 74. This enables the gate G to resist the force of the compression spring 18 and remain in a fully open position. To close the gate G, the user supplies a closing force that unseats the guide 70 from the notch 74.

To enable adjustment of the closing force supplied by the compression spring 12, the vertical position of the head 22 of the hinge pin 12 is adjusted by use of a set screw 80 threadably received by a threaded bore 82 of the hinge body 64 at a location proximate the head 22 of the hinge pin 12.

Figure 3:
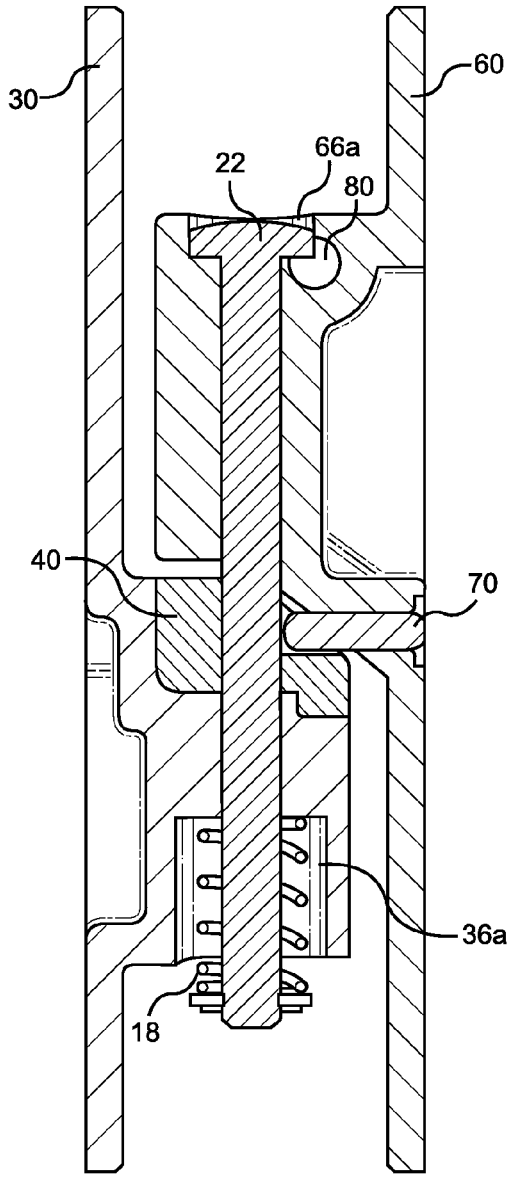
FIG. 3 is a cross-sectional view of hinge body portions of the hinge of FIG. 1 with a spring adjustment system thereof adjusted to slightly tension a spring component thereof to provide a relatively light closing force.
Figure 5:
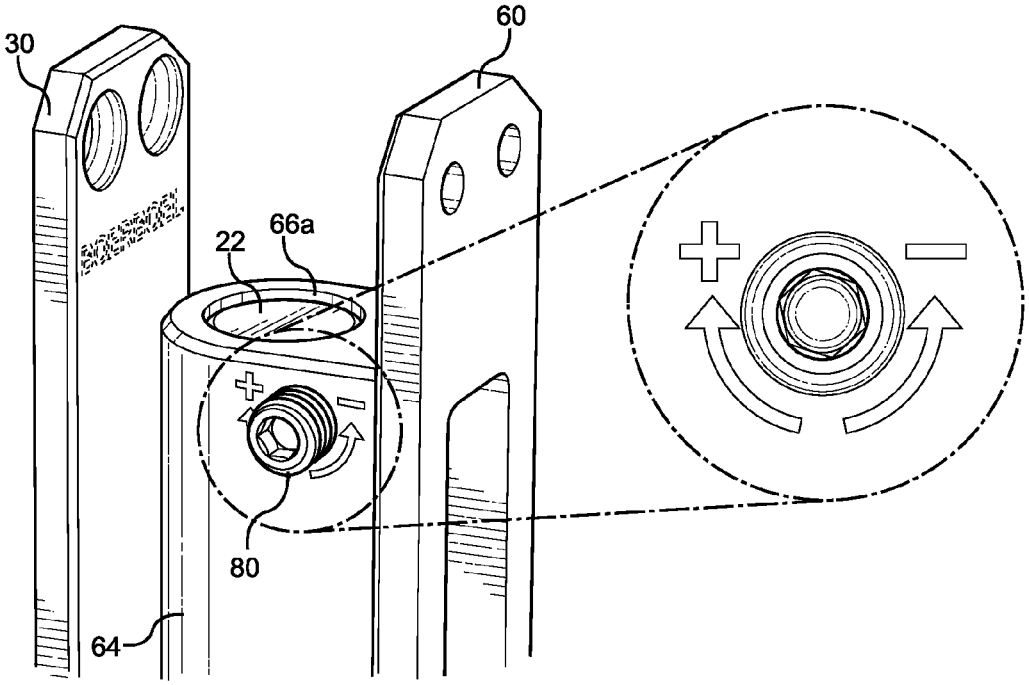
FIG. 5 is a close-up view of an upper portion of the cam hinge of FIG. 1 showing a spring adjustment components of the cam hinge cooperating with one another to slightly tension the spring component to provide a relatively light closing force.

With reference to FIGS. 3 and 5, the hinge 10 is shown with the compression spring 18 set to a minimum closing force. As will be seen, the set screw 80 is retracted substantially from the bore 82 so as to not engage the head 22 of the hinge pin 12. Thus, the head 22 is able to fully seat into the upper end 66*a* of the bore 66. This position of the pin 12 renders the compression spring 18 in a minimally compressed orientation to provide the weakest closing force.

Figure 4:
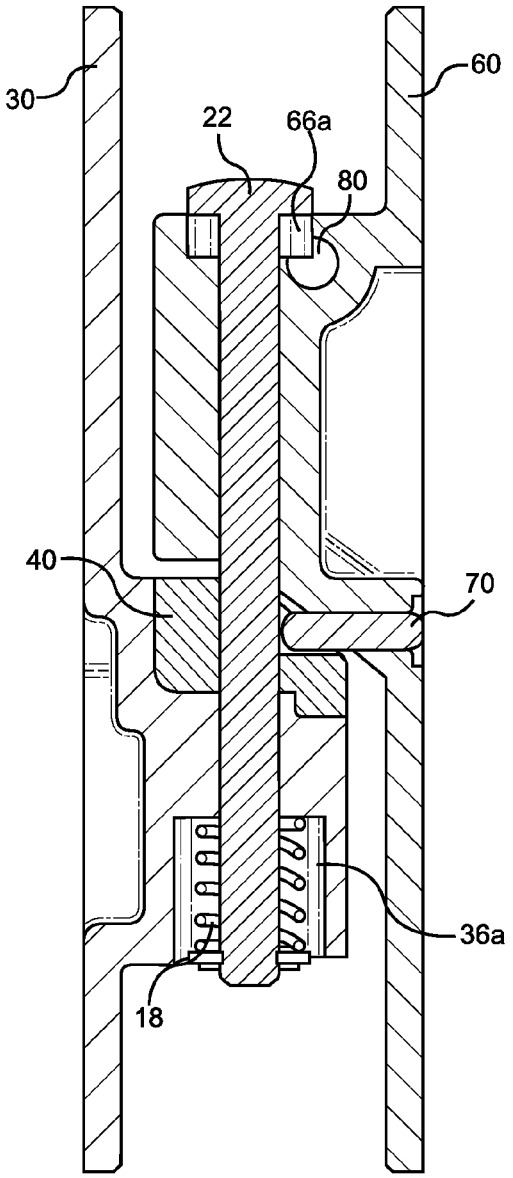
FIG. 4 is a cross-sectional view of hinge body portions of the hinge of FIG. 1 with a spring adjustment system thereof adjusted to increase tension of the spring component thereof to provide a stronger closing force.
Figure 6:
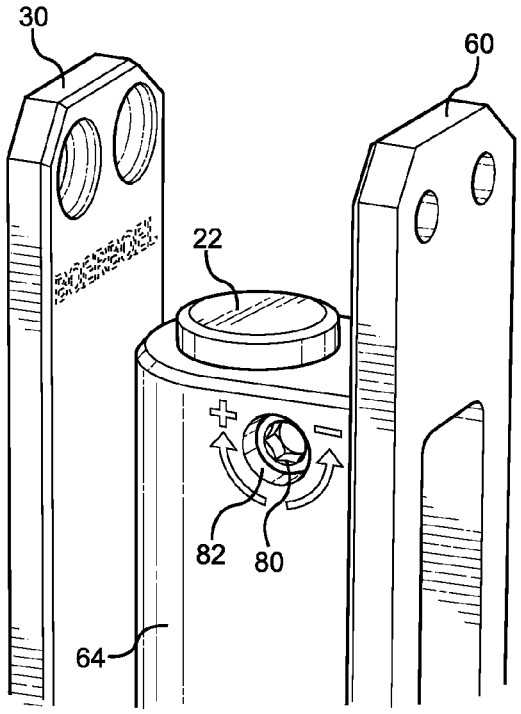
FIG. 6 is a close-up view of an upper portion of the cam hinge of FIG. 1 showing a spring adjustment components of the cam hinge cooperating with one another to tension the spring component to provide a relatively strong closing force.
Figure 7:
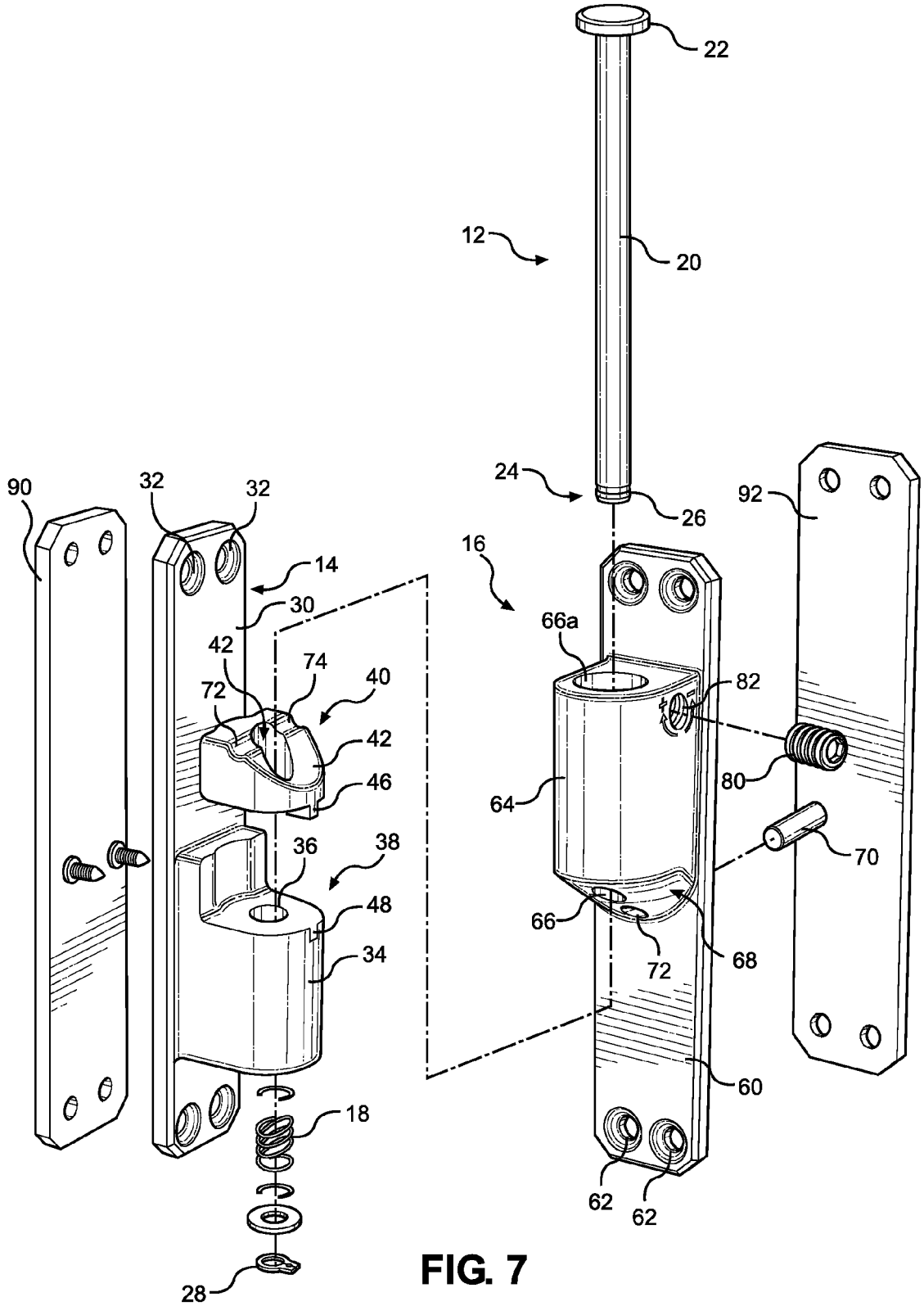
FIG. 7 is an exploded perspective view of portions of the cam hinge of FIG. 1.
Figure 8:
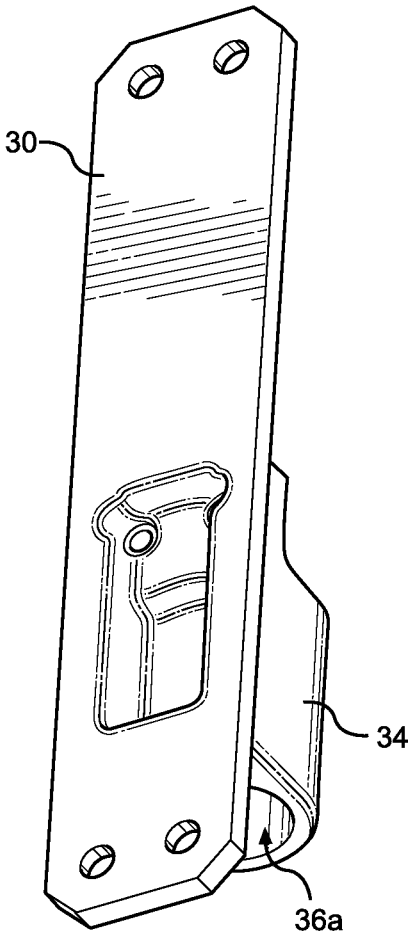
FIG. 8 shows a stationary hinge portion of the cam hinge of FIG. 1.
Figure 9:
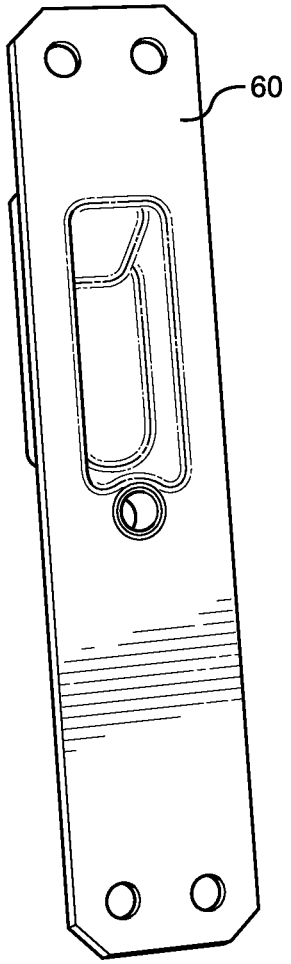
FIG. 9 shows a pivoting hinge portion of the cam hinge of FIG. 1.
Figure 10:
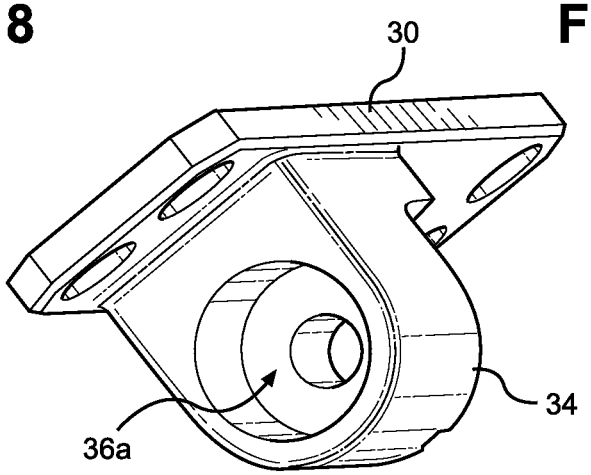
FIG. 10 shows a stationary hinge portion of the cam hinge of FIG. 1.

Turning now to FIGS. 4 and 6, the hinge 10 is shown with the compression spring 18 set to a maximum closing force. As will be seen, the set screw 80 is fully inserted into the bore 82 as by clockwise rotation of the set screw 80 into the bore 82 so as to position the set screw 80 fully span and engage the underside of the head 22 of the hinge pin 12. This relative positioning of the screw 80 and the head 22 serves to raise the pin 12. The lower end of the compression spring 18 is engaged by the retaining ring 28 fixed on the distal end 24 of the pin 12 so that raising of the pin 12 compresses the compression spring 18 in the lower end 36*a* of the bore 36 of the hinge body 34. This position of the pin 12 renders the compression spring 18 in a maximum compressed orientation so as to provide the strongest closing force.

The set screw 80 may be adjusted between the fully inserted and the retracted positions to enable incremental adjustment of the position of the head 22 of the pin 12 and hence incremental adjustment of the closing force of the spring 12. That is, the lower surface of the head 22 of the pin 12 and the set screw 80 cooperate so that as the distal end of the set screw 80 initially contacts the head 22, the head 22 is raised. As the set screw 80 is further screwed into the bore 80 it continues to span the lower side of the head 22 causing incremental rising of the head 22, with maximum rising of the head 22 achieved when the set screw 80 fully spans the underside of the head 22.

As will be appreciated, the described hinge 10 advantageously provides a cam hinge having spring assisted closing, with adjustability of the spring tension to provide adjustable closing speed.

The hinge 10 is particularly suitable for use as a hinge for attaching a fence gate to a fence post, and particularly for a vinyl fence and gate. In this regard, the components for the hinge 10 described above are generally formed of sturdy metal suitable for use as a hinge. However, to facilitate mounting to a vinyl post and a vinyl gate, the hinge 10 may further include mounting pads 90 and 92 configured to connect to and abut the bases 30 and 60, respectively. The pads 90 and 92 are desirably formed of a vinyl material so that the bases 30 and 60 do not mar or dig into the pot or gate to which they are installed. Also, screw receivers 94 and 96 are located on the opposite surface of the post or gate from the bases 30 and 60, respectively, for receiving the mounting screws or other fasteners. The screw receivers 94 and 96 are desirably formed of metal.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A self-closing and adjustable closing force cam hinge, comprising:

a stationary hinge portion having a hinge body;

a pivoting hinge portion having a hinge body;

a hinge pin having a head and passing through a hinge pin bore of the hinge body of the stationary hinge portion and the hinge body of the pivoting hinge portion, wherein the pivoting hinge portion pivots about the hinge pin relative to the stationary hinge portion and cooperates with the stationary hinge portion to enable the pivoting hinge portion to lift as the pivoting hinge portion is rotated from a closed position to an open position and to lower as the pivoting hinge portion is rotated from the open position to the closed position;

a compression spring located on the hinge so that the hinge pin passes through the compression spring and the head of the hinge pin is retracted from the compression spring to compress the compression spring so that the compression spring applies a closing force to the hinge when the hinge is in the open position; and a spring adjuster comprising an adjustably positionable body that is adjustably positionable relative to the head of the hinge pin so that adjustment of the position of the adjustably positionable body raises or lowers the head of the hinge pin such that raising of the hinge pin increases compression of the compression spring to increase the closing force applied by the compression spring and lowering of the hinge decreases compression of the compression spring to decrease the closing force applied by the compression spring, wherein the adjustably positionable body comprises a set screw threadably inserted into a threaded bore of the hinge body of the pivoting hinge portion, with the threaded bore located proximate the hinge pin bore of the hinge body of the pivoting hinge portion into which the head of the hinge pin is receivable.

2. The hinge of claim 1, wherein the head of the hinge pin is located on the pivoting hinge portion.

3. The hinge of claim 1, wherein the compression spring is located on the stationary hinge portion.

4. A self closing and adjustable closing force hinge, comprising:

a hinge openable and closeable between an open position and a closed position, the hinge having a compression spring located on the hinge so that a hinge pin passes through a hinge pin bore of a hinge body and the compression spring and a head of the hinge pin is retracted in a direction away from the compression spring to compress the compression spring so that the compression spring applies a closing force to the hinge when the hinge is in an open position; and a spring adjuster having an adjustably positionable body that is adjustably positionable relative to the head of the hinge pin, wherein adjustment of the position of the adjustably positionable body raises or lowers the head of the hinge pin such that raising of the hinge pin increases compression of the compression spring to increase the closing force applied by the compression spring and lowering of the hinge decreases compression of the compression spring to decrease the closing force applied by the compression springs wherein the adjustably positionable body comprises a set screw threadably inserted into a threaded bore of the hinge body of the pivoting hinge portion, with the threaded bore located proximate the hinge pin bore of the hinge body of the pivoting hinge portion into which the head of the hinge pin is receivable.

5. The hinge of claim 1 further comprising a cam insert coupled to an upper end of the hinge body of the stationary hinge portion.

6. The hinge of claim 4 further comprising a stationary hinge portion coupled to the compression spring.

* * * * *